United States Patent [19]

Denier et al.

[11] 4,141,723

[45] Feb. 27, 1979

[54] PROCESS FOR PRODUCING STAINLESS STEEL

[75] Inventors: Guy Denier; Pierre Vayssiere, both of Metz; Georges Giroud, Dunkerque; Jean-Claude Grosjean, Metz, all of France

[73] Assignee: Institut de Recherches de la Siderurgie Francaise (IRSID), Saint-Germain-en-Laye, France

[21] Appl. No.: 828,994

[22] Filed: Aug. 30, 1977

[30] Foreign Application Priority Data

Sep. 20, 1976 [FR] France ..... 76 282470

[51] Int. Cl.[2] ..... C21C 5/34

[52] U.S. Cl. ..... 75/60; 75/59

[58] Field of Search ..... 75/51, 52, 59, 60

[56] References Cited

U.S. PATENT DOCUMENTS

| | | | |
|---|---|---|---|
| 3,003,865 | 10/1961 | Bridges | 75/60 |
| 3,046,107 | 7/1962 | Nelson | 75/59 |
| 3,751,242 | 8/1973 | Knuppel | 75/60 |
| 3,854,932 | 12/1974 | Bishop | 75/60 |
| 4,001,012 | 1/1977 | Rote | 75/51 |

*Primary Examiner*—P. D. Rosenberg

*Attorney, Agent, or Firm*—Kurt Kelman

[57] ABSTRACT

Stainless steel is produced in a converter with a tuyere defining a central conduit and a peripheral conduit concentrically surrounding the central conduit, by blowing an oxidizing refining gas through the central conduit into a molten metal bath, the refining gas initially consisting of pure oxygen and being subsequently diluted by gaseous argon, and injecting liquid argon into the converter through the peripheral conduit, to refine the molten metal bath until it has attained a desired level of carbon.

4 Claims, No Drawings

PROCESS FOR PRODUCING STAINLESS STEEL

The present invention relates to an improved process for producing stainless steel from a molten metal bath in a converter having a tuyere defining a central conduit and a peripheral conduit concentrically surrounding the central conduit. It can be applied to any stainless steel manufacturing process, particularly for making stainless steels of very low carbon content, and is designed to increase the operating life of the tuyeres and of the refractory lining of the converter.

The production of stainless steel causes problems due to the requirement of keeping the content of chromium in the steel high while holding that of carbon to a minimum. The existence of an equilibrium between the carbon, chromium and oxygen imposes, however, a lower limit on the content of carbon in the metal bath, depending on the specific operating conditions.

In conventional processes for producing stainless steel, a charge composed principally of stainless steel scrap was refined in an electric arc furnace. But with these methods it was not possible to produce very soft steels, at least if the starting materials contained very little chromium, and to refine with the addition of ferrochromium materials having a very low carbon content. The injection of oxygen into the electric arc furnace considerably increased the temperature of the molten metal bath therein and thus led to displacements in the carbon-chromium-oxygen equilibrium. Nevertheless, even under these conditions, it was not possible directly to make stainless steels containing less than 0.04% carbon. Furthermore, the very high temperatures necessary for this process involved a high energy consumption and led to rapid wear of the refractory lining of the furnace.

Operating in vacuum and, even more importantly, with a gaseous carbon oxide diluent provided considerable improvements in this process to reach very low carbon contents without an excessive drop in the chromium content and without an excessive refining temperature increase. Subsequently, further improvements in the economy of the process were achieved by the use of less expensive diluents.

It is the primary object of this invention to provide an improved process for producing stainless steel, which has the notable advantage of increasing the operating life of the refractory lining of the refining vessel.

The above and other objects are accomplished in accordance with the invention in a converter of the indicated type by blowing an oxidizing refining gas through the central conduit of the tuyere into the molten metal bath, the refining gas initially consisting of substantially pure oxygen and being subsequently diluted by gaseous argon, and injecting liquid argon into the converter through the peripheral tuyere conduit, to refine the molten metal bath until it has attained a desired level of carbon.

While it is possible to start the dilution with gaseous argon before the content of carbon in the metal bath is close to equilibrium with that of the chromium at the temperature of the bath, it is preferred to blow substantially pure oxygen into the molten metal bath until the content of carbon in the metal bath is close to equilibrium with that of the chromium at the temperature of the bath, and then to dilute the oxygen with a volume of the gaseous argon in excess of that of the oxygen until the molten metal bath has attained the desired carbon level.

In the conventional processes, the diluent gas has two distinct functions: it is an operative component of the metallurgical reaction and it serves to cool the tuyeres. The first one of these functions is effectuated during the refining and consists of displacing the carbon-chromium-oxygen equilibriums by reducing the partial pressure of the carbon oxide towards a preponderant oxidation of carbon. The second function is effectuated during the entire time the diluent gas is blown in although it is not considered as the principal function.

It will be understood that the concept whereon the present invention is based is to dissociate the two functions partially and to have them fulfilled by a single body, i.e. the argon, under two physical states each of which is especially adapted to accomplish one of these functions.

In effect, if liquid and gaseous argon are compared from the point of view of cooling agents, it will be noted that gaseous argon heated from an approximate temperature of 25° C. to about 1600° C. absorbs 196 kilo calories per kilogram, while liquid argon absorbs 260 kilo calories per kilogram. Furthermore, it has been unexpectedly found that the energy absorption is localized at the nose of the tuyere with a liquefied gas and, subsequently, the effect is even more significant than could be expected from the thermodynamic properties. Therefore, the same cooling effect is obtained with much less liquid argon than gaseous argon and the liquid argon will lower the temperature of the tuyeres substantially to reduce wear.

According to one feature of this invention, gaseous argon is blown in only during that period of the refining proper when equilibrium has been approached . On the other hand, to fulfill the metallurgical function of the argon, only the amount of the argon counts, and, therefore, a sufficient amount of argon must be blown in to dilute the carbon oxide effectively. It is accordingly advantageous to use the argon in the gaseous state and to blow in a gaseous mixture of oxygen and argon with an excess amount of argon in the mixture. Liquid argon is injected during this portion of the refining process to cool the tuyeres effectively.

In this manner, cooling of the tuyeres may be controlled independently from the metallurgical problems of decarbonization, and it is possible to obtain a high degree of economy in the use of this important element by judiciously employing argon in its two physical states during the course of the refining process. The saving is of the order of one quarter of the amount of argon needed, compared to its use in gaseous form only.

One of the problems encountered in the production of stainless steel in conventional processes has been the maintenance of the refractories in the refining vessel. Usually, a lining has lasted for about 40 to about a hundred charges. The major wear occurs not at the level of the very corrosive slag but at that of the tuyeres. Since the process of the present invention produces a more efficient cooling of the tuyeres, it will prolong the life of the lining, which is an important advantage of this invention. Preferably, the tuyeres are disposed in the bottom of the converter and not in the side walls so that any repairs may be made simply by changing the bottom.

If the tuyeres are cooled solely by gaseous argon, it is impossible to have a very long refining period proper, i.e. a period before the equilibrium has been approached, because of the insufficient protection of the tuyeres, and thus to blow in a large volume of oxygen.

Subsequently, it is not possible with such a process to refine charges having a high initial content of carbon, such as the usual charges initially containing 1.5% to 3% carbon. With the process of the invention, on the other hand, the tuyeres are effectively cooled so as to permit prolongued refining periods without causing undue wear. Thus, the starting materials may contain substantial amounts of carbon, and charges of chromium melts containing up to about 7% carbon may be used.

If desired, the liquid argon may be replaced by liquid oxygen during the refining period proper, thus using the tuyere cooling method described and claimed in copending application Ser. No. 828,995, filed concurrently and entitled "Steel Refining Process". It is also possible to use liquid nitrogen as a cooling agent during this period. Liquid oxygen and liquid nitrogen are less expensive than liquid argon and, therefore, are economically advantageous as substituents in this part of the process. It will be understood that, when the carbon-chromium-oxygen equilibrium is approached, a mixture of oxygen and argon gas is blown into the converter through the central tuyere conduit and liquid argon is injected through the peripheral conduit of the tuyere.

The process of the present invention may be carried out without any particular new structural arrangements in conventional steel defining converters with double-feed tuyeres of the indicated type. Such tuyeres are presently used in bottom-blown converters and are usually formed of two coaxial pipes defining therebetween an annular space of suitable cross sectional area. It is also possible to use triple-feed tuyeres with three coaxially mounted pipes, the oxygen refining gas being blown in through the central conduit, the gaseous argon through the intermediate annular conduit, and the liquid argon being injected through the outer annular conduit. Refining converters usually have several tuyeres which are preferably mounted in the bottom but it will be understood that the steel-making process of the invention works also with different tuyere arrangements.

The following example illustrates the process:

The charge is melted in an electric arc furnace and contains from 1.5% to 3.0% carbon and 0.5 to 1.5% silicon. The chromium content corresponds substantially to that desired in the stainless steel to be produced. After the charge has been melted and poured from the furnace into the converter, refining is initiated by blowing pure oxygen through the central conduit of the tuyeres, and liquid argon is injected through the peripheral conduit thereof. The blowing of pure oxygen may continue until the carbon content in the molten metal bath has approached equilibrium with that of the chromium in the bath, i.e. generally a content of about 0.3% carbon. But it is also possible to start mixing gaseous argon with the pure oxygen in relatively small quantities (the ratio, in respective volumes, between oxygen and argon being at most equal to 2 : 1) before this equilibrium content has been reached. As soon as the carbon content has reached equilibrium with the chromium, it is necessary to displace the carbon-oxygen equilibrium to avoid undue oxidation of the chromium. For this purpose, the quantity of oxygen blown into the metal bath is reduced and that of the gaseous argon is increased until the two gases reach a ratio, in volume, of the order of 1 : 2. Meanwhile, injection of the liquid argon is continued but, since the larger amount of gaseous argon blown in participates in cooling the tuyeres, the delivery of liquid argon may be reduced. Upon reaching the desired carbon content in the bath, which may be less than 0.01%, delivery of oxygen is discontinued while gaseous argon is continued to be blown in to proceed with the reduction of chromium which, in small quantities, may have been oxidized. This reduction of chromium is effected with the aid of ferro-silicon and/or aluminum additives. The final additions are then made, as is conventional in the production of stainless steel, to adjust the amounts of the alloy components to their desired levels, and the metal bath is finally desulfurized. The refined bath is then removed from the converter.

The stainless steel production process of the present invention requires about 15 to 25 cubic meters, at atmospheric pressure, of oxygen per ton of charge, as well as about 0.1 to 0.3 kg of liquid argon per cubic meter, at atmospheric pressure, of oxygen blown into the converter. This argon is under a pressure of about 1 to 10 bars and its temperature is about −170° C.

The stainless steel obtained by the process has a very low carbon content and involves only small chromium losses during refining while considerable increasing and operating life of the tuyeres and refractories.

What is claimed is:

1. A process for producing stainless steel having a desired chromium content from a molten metal bath initially containing said content of chromium in a converter having a bottom with a tuyere defining a central conduit and a peripheral conduit concentrically surrounding the central conduit, comprising the steps of blowing an oxidizing refining gas through the central conduit into the molten metal bath, the refining gas initially consisting of substantially pure oxygen, subsequently diluting the pure oxygen refining gas by gaseous argon, and injecting liquid argon into the converter through the peripheral conduit, to refine the molten metal bath until it has attained a desired level of carbon.

2. The steel producing process of claim 1, wherein the substantially pure oxygen is blown into the molten metal bath until the content of carbon in the metal bath is close to equilibrium with that of the chromium at the temperature of the bath, and the oxygen is then diluted with a volume of the gaseous argon in excess of that of the oxygen.

3. The steel producing process of claim 1, wherein the liquid argon is injected from the beginning of the refining until the molten metal bath has attained a desired level of carbon.

4. The steel producing process of claim 1, wherein the liquid argon injection is initiated subsequent to the blowing of oxygen, and a liquid cooling agent selected from the group consisting of liquid oxygen and liquid nitrogen is injected through the peripheral conduit between the time oxygen blowing and liquid argon injection are initiated.

* * * * *